US009389547B1

(12) United States Patent
Tokuyama et al.

(10) Patent No.: US 9,389,547 B1
(45) Date of Patent: Jul. 12, 2016

(54) TRANSFER-AND-TRANSPORT DEVICE AND IMAGE FORMING APPARATUS

(71) Applicant: FUJI XEROX CO., LTD., Tokyo (JP)

(72) Inventors: Atsuhito Tokuyama, Kanagawa (JP); Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/711,012

(22) Filed: May 13, 2015

(30) Foreign Application Priority Data

Dec. 24, 2014 (JP) ..... 2014-260611

(51) Int. Cl.
*G03G 15/16* (2006.01)

(52) U.S. Cl.
CPC ..... *G03G 15/166* (2013.01); *G03G 2215/1661* (2013.01)

(58) Field of Classification Search
CPC ..... G03G 15/166; G03G 15/168; G03G 2215/1661
USPC ..... 399/101, 303, 312, 313
See application file for complete search history.

(56) References Cited

U.S. PATENT DOCUMENTS

2004/0156653 A1* 8/2004 Takehara ..... G03G 15/167 399/167

FOREIGN PATENT DOCUMENTS

| | | | | |
|---|---|---|---|---|
| JP | 01209456 | A | * | 8/1989 |
| JP | 10-268601 | A | | 10/1998 |
| JP | 11149224 | A | * | 6/1999 |
| JP | 2000155516 | A | * | 6/2000 |
| JP | 2000305337 | A | * | 11/2000 |
| JP | 2003323057 | A | * | 11/2003 |
| JP | 2005-301141 | A | | 10/2005 |
| JP | 2006-184796 | A | | 7/2006 |
| JP | 2011033787 | A | * | 2/2011 |

* cited by examiner

*Primary Examiner* — Robert Beatty
(74) *Attorney, Agent, or Firm* — Sughrue Mion, PLLC

(57) ABSTRACT

A transfer-and-transport device includes a substantially annular belt stretchable in a direction of rotation thereof, a transfer roller by which an outer peripheral surface of the belt is pressed against a photoconductor, supporting rollers supporting the belt in a tensed state, and a cleaning member cleaning the outer peripheral surface of the belt. One supporting roller is a driving roller provided, in the direction of rotation of the belt, on an upstream side of the transfer roller. Another supporting roller is a releasing-side roller provided, in the direction of rotation of the belt, on a downstream side of the transfer roller. The cleaning member is in contact with the belt in an area from, in the direction of rotation of the belt, a midpoint of a portion wrapped around the driving roller toward the upstream side to a midpoint of a portion wrapped around the releasing-side roller.

4 Claims, 7 Drawing Sheets

| | RATE OF DIFFERENCE IN LINE WIDTH (%) | |
|---|---|---|
| | BRAND-NEW BELT | DETERIORATED BELT |
| COMPARATIVE EXAMPLE 1 | 0.25 | 0.31 |
| COMPARATIVE EXAMPLE 2 | 0.31 | 0.72 |
| WORKING EXAMPLE | 0.20 | 0.20 |

TRANSFER-AND-TRANSPORT DEVICE AND IMAGE FORMING APPARATUS

CROSS-REFERENCE TO RELATED APPLICATIONS

This application is based on and claims priority under 35 USC 119 from Japanese Patent Application No. 2014-260611 filed Dec. 24, 2014.

BACKGROUND

Technical Field

The present invention relates to a transfer-and-transport device and an image forming apparatus.

SUMMARY

According to an aspect of the invention, there is provided a transfer-and-transport device including a substantially annular belt that rotates in such a manner as to transport a recording medium received by an outer peripheral surface of the belt, the belt releasing the recording medium from the outer peripheral surface after transporting the recording medium, the belt being stretchable in a direction of rotation of the belt; a transfer roller that is rotatably provided such that the outer peripheral surface of the belt is pressed against a photoconductor, the photoconductor being driven to rotate while carrying a toner image to be transferred to the recording medium; a plural supporting rollers that support the belt at respective positions avoiding the transfer roller and such that the belt is rotatable in a tensed state; and a substantially plate-like cleaning member that cleans the outer peripheral surface of the belt with one end of the cleaning member being in contact with the outer peripheral surface of the belt. One of the plural supporting rollers serves as a driving roller provided at a position, in the direction of rotation of the belt, on an upstream side with respect to the transfer roller and on a side where the recording medium starts to be received by the belt. Another one of the plural supporting rollers serves as a releasing-side roller provided at a position, in the direction of rotation of the belt, on a downstream side with respect to the transfer roller and on a side where the recording medium is released from the belt. The cleaning member is in contact with the belt at a position in an area extending from, in the direction of rotation of the belt, a midpoint of a portion of the belt that is wrapped around the driving roller toward the upstream side up to a midpoint of a portion of the belt that is wrapped around the releasing-side roller.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
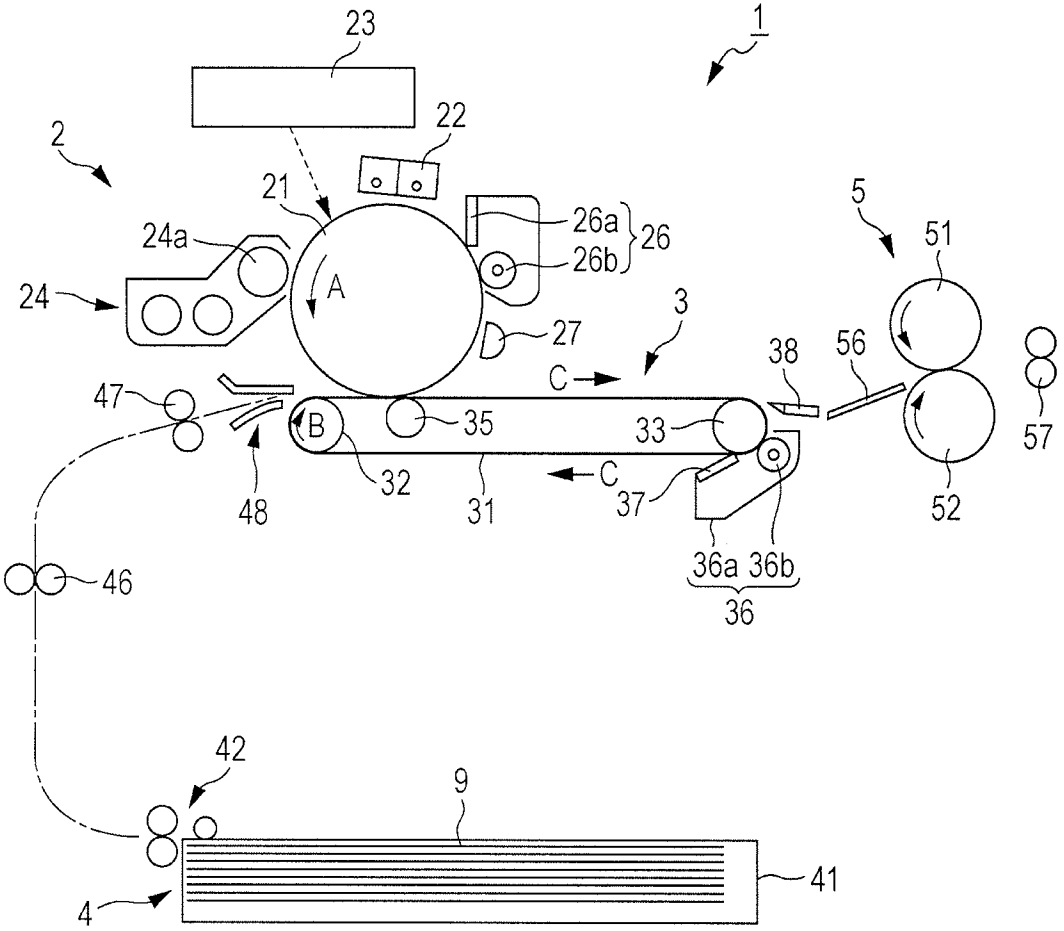
FIG. 1 schematically illustrates relevant elements of an image forming apparatus including a transfer-and-transport device according to a first exemplary embodiment.

FIG. 1 schematically illustrates relevant elements of an image forming apparatus according to a first exemplary embodiment.

Configuration of Relevant Elements of Image Forming Apparatus

An image forming apparatus 1 according to the first exemplary embodiment includes, in a housing (not illustrated), an image forming device 2 that forms a toner image on a photoconductive drum 21 by developing image information inputted to the image forming apparatus 1 with toner contained in developer, a transfer-and-transport device 3 that transfers the toner image formed on the photoconductive drum 21 in the image forming device 2 to a recording sheet 9 that is held and transported by a transfer-and-transport belt 31, a sheet feeding device 4 that contains and sequentially feeds recording sheets 9 to be supplied to a transfer part defined between the image forming device 2 and the transfer-and-transport device 3, a fixing device 5 that allows the recording sheet 9 to which the toner image has been transferred to pass therethrough and thus fixes the toner image to the recording sheet 9, and other associated elements. The dash-dot line illustrated in FIG. 1 represents a transport path along which the recording sheet 9 is transported to the transfer part, which will be described separately below.

The image forming device 2 includes the photoconductive drum 21 that is driven to rotate in a direction represented by an arrow A (hereinafter referred to as direction A), a charging device 22 that charges an image carrying surface on the periphery of the photoconductive drum 21, an exposure device 23 that applies light (the dotted line with an arrow head) generated on the basis of the image information to the charged image carrying surface of the photoconductive drum 21 and thus forms an electrostatic latent image on the image carrying surface, a developing device 24 that develops the electrostatic latent image on the image carrying surface of the photoconductive drum 21 with toner contained in the developer and thus forms a toner image, a drum cleaning device 26 that removes unwanted substances, such as residual toner, adhering to the image carrying surface of the photoconductive drum 21 that has undergone the transfer of the toner image, a pre-cleaning charger 27 that reduces the amount of charge of the residual toner on the image carrying surface after the toner image is transferred from the photoconductive drum 21 and before the residual toner reaches the drum cleaning device 26, and other associated elements.

The photoconductive drum 21 has the image carrying surface that includes a photoconductive layer (photosensitive layer) provided around a circular cylindrical or circular columnar conductive base member that is grounded. The photoconductive layer is made of an organic photosensitive material or the like. The photoconductive drum 21 receives power from a rotary driving device (not illustrated) and rotates in the direction A. The charging device 22 charges the image carrying surface of the photoconductive drum 21 to a predetermined potential of predetermined polarity and is, for example, a scorotron corona discharger. If, for example, the developing device 24 is of a reversal-development type, the polarity of the charging is set to the same as the polarity of charging of the toner supplied from the developing device 24.

The exposure device 23 applies light generated on the basis of image information (source) inputted to the image forming apparatus 1 from an external device to the charged image carrying surface of the photoconductive drum 21, thereby forming an electrostatic latent image having a predetermined latent-image potential on the image carrying surface. Examples of the exposure device 23 include a non-scanning exposure device including plural light-emitting diodes that are aligned in a substantially axial direction of the photoconductive drum 21, optical components, and other associated elements; and a scanning exposure device in which laser light is emitted while being scanningly moved in a substantially axial direction of the photoconductive drum 21 by a rotating polygon mirror.

The developing device 24 is a two-component developing device that uses a two-component developer (a developer containing a nonmagnetic toner and a magnetic carrier) as exemplary developer. Elements of the developing device 24 include a developing roller 24*a* that carries a predetermined amount of two-component developer contained in a developer container of the developing device 24 and transports the two-component developer to a development area where the developing roller 24*a* is provided in proximity to the photoconductive drum 21. A development voltage is supplied to the developing roller 24*a* of the developing device 24. The development voltage is generated by supplying, for example, a direct current on which an alternating current is superposed. The toner contained in the developer is triboelectrically charged to predetermined polarity (negative polarity in the first exemplary embodiment) by rubbing against the carrier while being stirred by a stirring-and-transporting member provided in the developer container of the developing device 24.

The drum cleaning device 26 includes, for example, a plate-like cleaning member (blade) 26*a*, a rotating brush 26*b*, and other associated elements. The cleaning member 26*a* extends in the axial direction of the photoconductive drum 21 and is in contact with a portion of the image carrying surface of the photoconductive drum 21 that has undergone transfer, thereby scraping substances adhering to the image carrying surface from the image carrying surface. The rotating brush 26*b* rotates while being in contact with a portion of the image carrying surface of the photoconductive drum 21 that has undergone transfer. The pre-cleaning charger 27 is, for example, a corona discharger or the like.

The transfer-and-transport device 3 is provided below the image forming device 2 in the direction of gravitational force. The transfer-and-transport device 3 has a function of transferring the toner image on the photoconductive drum 21 of the image forming device 2 to a recording sheet 9 that is transported by the transfer-and-transport belt 31, and a function of transporting the recording sheet 9 having the toner image toward the fixing device 5 by using the transfer-and-transport belt 31. Details of the transfer-and-transport device 3 will be described separately below.

The sheet feeding device 4 is provided below the transfer-and-transport device 3 in the direction of gravitational force. The sheet feeding device 4 basically includes one or more containers 41 that each contain a stack of recording sheets 9 of a desired size, kind, and so forth; and a feeding unit 42 provided for each of the containers 41 and that feeds the recording sheets 9 one by one from the container 41. The recording sheet 9 fed from the sheet feeding device 4 is transported to the transfer part (actually, a sheet receiving position on the transfer-and-transport belt 31) along a feed-and-transport path that extends from the sheet feeding device 4 to the transfer part defined between the image forming device 2 and the transfer-and-transport device 3. The feed-and-transport path is defined by plural pairs of transport rollers 46, 47, etc., transport guides (not illustrated), and other associated elements. The pair of transport rollers 47 serve as a pair of feed rollers having such functions as correcting the timing and the state of transport of the recording sheet 9, and the like. A sheet introducing member 48 provided at the terminal end of the feed-and-transport path (at an end of the transfer-and-transport device 3 that is on a sheet receiving side) allows the leading end of the recording sheet 9 to smoothly come into contact with the outer peripheral surface of the transfer-and-transport belt 31 of the transfer-and-transport device 3 and introduces the recording sheet 9 into the transfer-and-transport device 3.

The fixing device 5 is provided near the other end of the transfer-and-transport device 3 at which the recording sheet 9 is released from the transfer-and-transport belt 31. The fixing device 5 includes, in a housing (not illustrated), a heating rotary body 51, a pressing rotary body 52, and other associated elements. The heating rotary body 51 rotates in a direction represented by the arrow illustrated in FIG. 1 and is heated by a heating unit so that the surface temperature thereof is kept at a predetermined level. The heating rotary body 51 is of any type such as a roller type or a belt type. The pressing rotary body 52 extends in a substantially axial direction of the heating rotary body 51 and is in contact with the heating rotary body 51 under a predetermined pressure, whereby the pressing rotary body 52 rotates by following the rotation of the heating rotary body 51. The pressing rotary body 52 is of any type such as a roller type or a belt type. A transport guide member 56 is provided between the fixing device 5 and the transfer-and-transport device 3. The transport guide member 56 guides, to the fixing device 5, the recording sheet 9 that is released and discharged from the transfer-and-transport device 3 after the transfer. A pair of discharge rollers 57 and other associated elements are provided on a side of the fixing device 5 from which the recording sheet 9 that has undergone fixing is discharged. The pair of discharge rollers 57 transport the recording sheet 9 to a sheet receiving portion (not illustrated).

Details of Transfer-and-Transport Device

The transfer-and-transport device 3 includes the transfer-and-transport belt 31 having an annular or substantially annular shape and rotating in a direction represented by an arrow C (hereinafter referred to as direction of rotation C) while being supported basically by two supporting rollers 32 and 33, a transfer roller 35 provided rotatably and such that the outer peripheral surface of the transfer-and-transport belt 31 is pressed against the image carrying surface of the photoconductive drum 21, a belt cleaning device 36 removing unwanted substances, such as residual toner, adhering to the outer peripheral surface of the transfer-and-transport belt 31, a release assisting member 38 assisting the releasing of the recording sheet 9 from the outer peripheral surface of the transfer-and-transport belt 31 after the transfer, and other associated elements.

The transfer-and-transport belt 31 is an annular or substantially annular endless belt that is stretchable in the direction of rotation C thereof. To provide satisfactory resistance to heat and ozone, the transfer-and-transport belt 31 is a semiconductive belt member made of a material, such as chloroprene rubber (CR), ethylene propylene diene monomer (EPDM), acrylonitrile-butadiene rubber (NBR), or the like, exhibiting a resistance of 7.0 to 8.5 log Ω. The transfer-and-transport belt 31 may have a viscoelasticity represented by a Young's modulus of 5 MPa or higher and 15 MPa or lower in an environment at 22° C. The transfer-and-transport belt 31 has a predetermined length, a predetermined width, and a predetermined thickness that match the conditions, i.e., the overall configuration and dimensions, of the transfer-and-transport device 3. The recording sheet 9 is held on the outer peripheral surface of the transfer-and-transport belt 31 with an electrostatic attraction or the like.

The transfer-and-transport belt 31 is supported by the two supporting rollers 32 and 33 at respective positions avoiding the transfer roller 35 and in such a manner as to rotate in a tensed state. The transfer-and-transport belt 31 according to the first exemplary embodiment is supported by the two supporting rollers 32 and 33 provided at respective positions that are spaced apart from each other in the substantially horizontal direction by a predetermined distance with the transfer roller 35 interposed therebetween. The transfer-and-transport belt 31 is stretched under a certain tension between the two supporting rollers 32 and 33 that are, for example, fixed at the respective predetermined positions. Thus, the entirety of the transfer-and-transport belt 31 is maintained to be tense. The tension applied to the transfer-and-transport belt 31 is set such that, for example, the increment in the length (the rate of extension) of the transfer-and-transport belt 31 in the stretched state is below about 5% of the free length of the transfer-and-transport belt 31 that is yet to be stretched.

The supporting roller 32 on one side serves as a driving roller that is provided on the upstream side with respect to the transfer roller 35 in the direction of rotation C of the transfer-and-transport belt 31 and at a position (on a sheet introducing side) relatively near the photoconductive drum 21 where the recording sheet 9 starts to be held by the transfer-and-transport belt 31. The driving roller 32 includes a metal shaft and a surface layer provided around the metal shaft. The surface layer is made of a material, such as urethane or EPDM, which provides a certain level of frictional resistance. The driving roller 32 receives rotational power from a rotary driving device (not illustrated) and thus rotates in a predetermined direction B and at a predetermined speed.

The supporting roller 33 on the other side serves as a releasing-side roller that is provided on the downstream side with respect to the transfer roller 35 in the direction of rotation C of the transfer-and-transport belt 31 and at a position (on a sheet releasing side) relatively far from the photoconductive drum 21 where the recording sheet 9 is released from the transfer-and-transport belt 31. The releasing-side roller 33 includes a metal shaft and a surface layer provided around the metal shaft. The surface layer is made of a material, such as urethane or EPDM, which provides a certain level of frictional resistance. Alternatively, the releasing-side roller 33 may be a plain solid roller having a metal surface. The releasing-side roller 33 is supported in such a manner as to rotate by following the rotation of the transfer-and-transport belt 31.

The transfer roller 35 is rotatably provided in contact with the inner peripheral surface of the transfer-and-transport belt 31, whereby the outer peripheral surface of the transfer-and-transport belt 31 is pressed against the image carrying surface of the photoconductive drum 21 with a predetermined pressure. In the first exemplary embodiment, the transfer roller 35 is provided at a position slightly shifted from the center of the photoconductive drum 21 toward the releasing-side roller 33 so that the transfer-and-transport belt 31 runs along the curve of the image carrying surface of the photoconductive drum 21 by a certain length with the aid of the driving roller 32. The transfer roller 35 includes a metal shaft and an elastic surface layer provided around the metal shaft. The elastic surface layer is made of a material such as foamed polyurethane rubber, CR, EPDM, or NBR. A predetermined transfer current is supplied to the shaft of the transfer roller 35 from a bias power source (not illustrated). In the first exemplary embodiment, the transfer current is of positive polarity.

The belt cleaning device 36 includes a housing **36*a*. The housing 36*a* has an opening provided in a portion thereof facing the outer peripheral surface of the transfer-and-transport belt 31 and extending in the width direction of the transfer-and-transport belt 31. A plate-like or substantially plate-like cleaning member 37 and a rotating brush 36*b* are provided at the opening of the housing 36*a* and are in contact with the outer peripheral surface of the transfer-and-transport belt 31**.

Specifically, the plate-like or substantially plate-like cleaning member 37 is provided at a position in the opening of the housing **36*a* that is on the downstream side, i.e., at one of the long-side ends of the opening, in the direction of rotation C of the transfer-and-transport belt 31. The cleaning member 37 has a tip 37*a* (see FIG. 2), which is a free end, and is fixed with the tip 37*a* being kept in contact with the outer peripheral surface of the transfer-and-transport belt 31 and being oriented against the direction of rotation C of the transfer-and-transport belt 31. The plate-like or substantially plate-like cleaning member 37 is a long, thin, rectangular member made of a material such as polyurethane rubber. The rotating brush 36*b* includes a shaft and brush bristles that are provided around the periphery of the shaft at a predetermined density, whereby the rotating brush 36*b* as a whole has a roller shape. The rotating brush 36*b* is provided at a position in the opening of the housing 36*a* that is on the upstream side, i.e., on the other long-side end of the opening, in the direction of rotation C of the transfer-and-transport belt 31. The brush bristles of the rotating brush 36*b* are in contact with the outer peripheral surface of the transfer-and-transport belt 31 that is rotatable, and the rotating brush 36*b* is rotatable by following the rotation of the transfer-and-transport belt 31. Details of the belt cleaning device 36** will be described separately below.

The release assisting member 38 functions as a sheet guide having a tapered tip, and is oriented such that the tip is located near a position on the outer peripheral surface of the transfer-and-transport belt 31 where the transfer-and-transport belt 31 starts to curve along the releasing-side roller 33. The leading end of the recording sheet 9 does not tend to be released smoothly from the outer peripheral surface of the transfer-and-transport belt 31 at the position where the transfer-and-transport belt 31 starts to curve along the releasing-side roller 33. Therefore, the release assisting member 38 starts to release the leading end of the recording sheet 9 from the outer peripheral surface of the transfer-and-transport belt 31.

Figure 2:
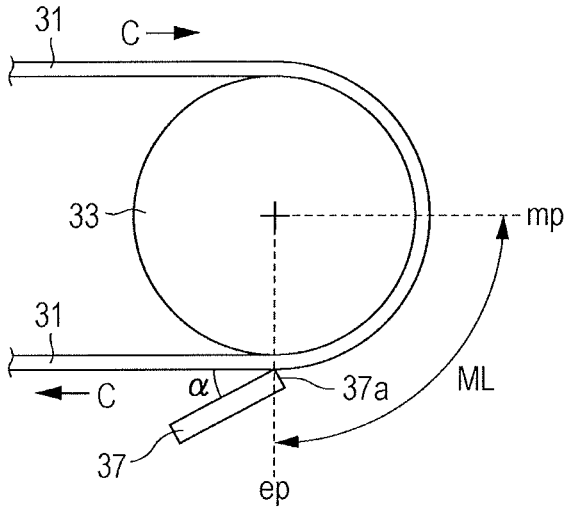
FIG. 2 illustrates the position of a cleaning member included in the transfer-and-transport device illustrated in FIG. 1.

In the transfer-and-transport device 3, as illustrated in FIGS. 1, 2, and others, the plate-like or substantially plate-like cleaning member 37 of the belt cleaning device 36 is in contact with the transfer-and-transport belt 31 within an area ML extending from, in the direction of rotation C of the transfer-and-transport belt 31, a midpoint mp of a portion of the transfer-and-transport belt 31 that is wrapped around the releasing-side roller 33 up to a downstream end point ep of the portion.

In the belt cleaning device 36 according to the first exemplary embodiment, the tip 37*a* of the plate-like or substantially plate-like cleaning member 37 is in contact with the transfer-and-transport belt 31 at a position slightly on the upstream side with respect to the end point ep. In the first exemplary embodiment, the angle of contact (attaching angle) $\alpha$ of the cleaning member 37 with respect to the outer peripheral surface of the transfer-and-transport belt 31 falls within a predetermined range, and the linear pressure at which the cleaning member 37 is in contact with the outer peripheral surface of the transfer-and-transport belt 31 falls within a predetermined range.

In the transfer-and-transport device 3, a speed of rotation Vd of the driving roller 32 is higher than a speed of rotation Vp of the photoconductive drum 21 (Vd>Vp). The speeds of rotation Vd and Vp are set by setting the conditions of controllers provided for the rotary driving devices that drive the driving roller 32 and the photoconductive drum 21, respectively.

Operations and so Forth of Image Forming Apparatus and Transfer-and-Transport Device An image forming operation performed by the image forming apparatus 1, an operation performed by the transfer-and-transport device 3, and so forth will now be described.

When the image forming apparatus 1 receives a command for an image forming operation, the image forming device 2, the transfer-and-transport device 3, the sheet feeding device 4, and the fixing device 5 are activated.

First, in the image forming device 2, the image carrying surface of the photoconductive drum 21 rotating in the direction A is charged to a predetermined potential of predetermined polarity (negative polarity in the first exemplary embodiment) by the charging device 22. Subsequently, the charged image carrying surface of the photoconductive drum 21 is exposed to light generated on the basis of image information and emitted from the exposure device 23, whereby an electrostatic latent image having the predetermined potential is formed on the image carrying surface. Subsequently, the electrostatic latent image on the image carrying surface of the photoconductive drum 21 is developed and visualized (by reversal development) into a toner image with toner charged to predetermined polarity (negative polarity) and supplied from the developing device 24. Then, as the photoconductive drum 21 rotates, the toner image is transported to the transfer part that faces the transfer roller 35.

Meanwhile, in the sheet feeding device 4, a desired recording sheet 9 is fed into the feed-and-transport path synchronously with the image forming operation performed by the image forming device 2. Subsequently, the pair of transport rollers 47 feed the recording sheet 9 to the sheet receiving position on the transfer-and-transport belt 31 of the transfer-and-transport device 3 (for example, a position on the outer peripheral surface of the transfer-and-transport belt 31 that corresponds to a position where the transfer-and-transport belt 31 goes out of contact with the driving roller 32). The recording sheet 9 is then held on the outer peripheral surface of the transfer-and-transport belt 31 with an electrostatic attraction or the like, and is introduced into the transfer part defined between the photoconductive drum 21 of the image forming device 2 and a portion of the transfer-and-transport belt 31 that is supported by the transfer roller 35.

Subsequently, the recording sheet 9 that is held on the transfer-and-transport belt 31 of the transfer-and-transport device 3 comes into contact with the image carrying surface of the photoconductive drum 21 at the transfer part and passes through the transfer part. In this process, the toner image on the image carrying surface of the photoconductive drum 21 is electrostatically attracted to the recording sheet 9 with the effect of a transfer electrical field generated between the transfer roller 35 and the photoconductive drum 21, whereby the toner image is transferred to the recording sheet 9. A portion of the image carrying surface of the photoconductive drum 21 from which the toner image has been transferred undergoes charge-adjusting operation performed by the pre-cleaning charger 27. Subsequently, unwanted substances, such as residual toner, adhering to the image carrying surface of the photoconductive drum 21 are removed from the image carrying surface by the drum cleaning device 26.

Subsequently, in the transfer-and-transport device 3, the recording sheet 9 now having the toner image and held by the transfer-and-transport belt 31 is transported by the transfer-and-transport belt 31 that is under rotation. When the recording sheet 9 reaches a sheet releasing position where the transfer-and-transport belt 31 starts to be wrapped around the releasing-side roller 33, the recording sheet 9 is released from the outer peripheral surface of the transfer-and-transport belt 31 with a straight-advancing characteristic of the recording sheet 9 having a certain level of stiffness and/or with the aid of the release assisting member 38. After the recording sheet 9 is released from the transfer-and-transport belt 31, the outer peripheral surface of the transfer-and-transport belt 31 is cleaned by the belt cleaning device 36 that removes unwanted substances, such as residual toner and paper lint, adhering to the outer peripheral surface of the transfer-and-transport belt 31.

Subsequently, the recording sheet 9 thus released from the outer peripheral surface of the transfer-and-transport belt 31 of the transfer-and-transport device 3 is guided to the transport guide member 56, is introduced into the fixing device 5, and undergoes a fixing process (is subjected to heat and pressure) by passing through the contact part between the heating rotary body 51 and the pressing rotary body 52 of the fixing device 5. Thus, the toner image having been transferred to the recording sheet 9 is fixed to the recording sheet 9. Lastly, the recording sheet 9 having undergone the fixing process is discharged from the fixing device 5 and is transported to the sheet receiving portion (not illustrated) by the pair of discharge rollers 57.

Through the above series of processes, a basic image forming operation ends.

Figure 3:
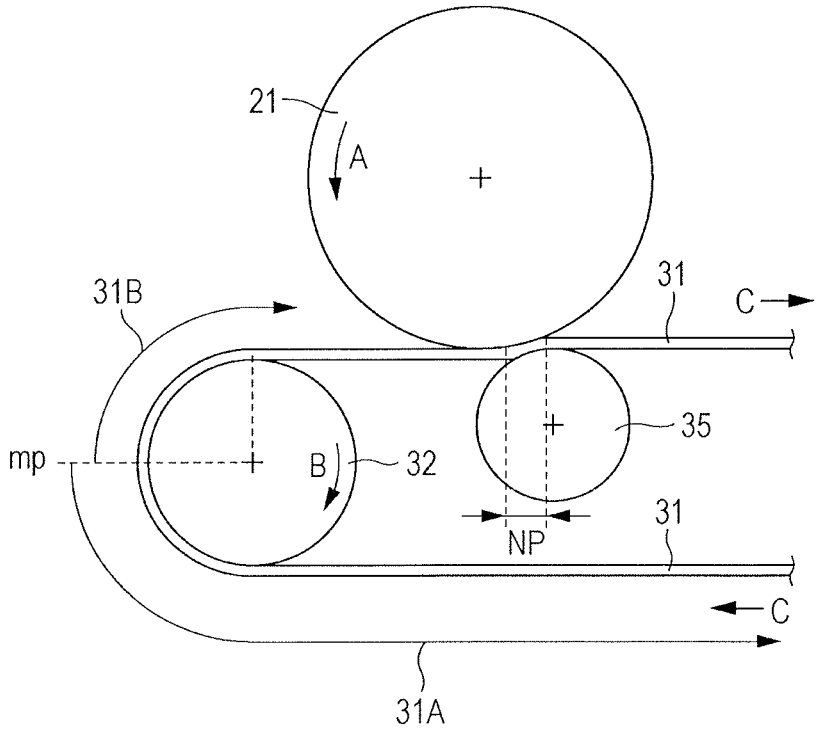
FIG. 3 illustrates a state of a transfer-and-transport belt included in the transfer-and-transport device illustrated in FIG. 1.

In the transfer-and-transport device 3, as illustrated in FIGS. 1, 3, and others, the transfer-and-transport belt 31 rotates in the direction C with the supply of rotational power from the driving roller 32 positioned on the sheet receiving side and rotating in the direction B.

Hence, when the transfer-and-transport belt 31 receives the rotational power from the driving roller 32, the transfer-and-transport belt 31 is naturally tensed relatively strongly in an upstream part (or a sheet-free-side portion) 31A thereof that extends from, in the direction of rotation C, a midpoint mp of a portion wrapped around the driving roller 32 toward the upstream side up to the midpoint mp of the portion wrapped around the releasing-side roller 33. In contrast, a downstream part (or a sheet-receiving-side portion) 31B of the transfer-and-transport belt 31 that extends from, in the direction of rotation C, the midpoint mp of the portion wrapped around the driving roller 32 toward the downstream side up to the position where the transfer roller 35 and the photoconductive drum 21 nip the transfer-and-transport belt 31 is not tensed strongly and is therefore relatively loose.

Consequently, as illustrated in FIG. 3, when the downstream part 31B of the transfer-and-transport belt 31 that extends from the point where the transfer-and-transport belt 31 goes out of contact with the driving roller 32 up to the transfer part passes through a transfer nip NP where the transfer-and-transport belt 31 is pressed against the photoconductive drum 21 by the transfer roller 35, the speed of rotation (movement) of the transfer-and-transport belt 31 is controlled by the speed of rotation of the photoconductive drum 21 that rotates at a higher speed than the driving roller 32. Therefore, the transfer-and-transport belt 31 rotates stably at the same speed as the photoconductive drum 21. Accordingly, the recording sheet 9 that is held on the outer peripheral surface of the transfer-and-transport belt 31 and is about to be introduced into the transfer part passes through the transfer part stably at substantially the same speed as the photoconductive drum 21. Hence, the occurrence of the speed difference between the recording sheet 9 and the image carrying surface of the photoconductive drum 21 is suppressed as much as possible.

In the transfer-and-transport device 3, as illustrated in FIGS. 1, 2, and others, the plate-like or substantially plate-like cleaning member 37 of the belt cleaning device 36 is in contact with the transfer-and-transport belt 31 substantially at the downstream end point ep, in the direction of rotation C, of the portion wrapped around the releasing-side roller 33. Thus, the outer peripheral surface of the transfer-and-transport belt 31 after the recording sheet 9 is released therefrom (i.e., a portion of the outer peripheral surface that has passed the sheet releasing position) is cleaned.

That is, the plate-like or substantially plate-like cleaning member 37 of the belt cleaning device 36 is in contact with the transfer-and-transport belt 31 at a position of the upstream part (or the sheet-free-side portion) 31A that is in a tensed state as described above. In general, the contact between the transfer-and-transport belt 31 and the cleaning member 37 may impose some load that hinders the rotation of the transfer-and-transport belt 31 and may trigger slight and random extension and contraction of the transfer-and-transport belt 31, which may lead to changes in the speed of rotation of the transfer-and-transport belt 31. However, since the portion of the transfer-and-transport belt 31 with which the cleaning member 37 is in contact is tensed, the transfer-and-transport belt 31 stably rotates with substantially no changes in the speed of rotation thereof that may be caused by the contact with the cleaning member 37. Moreover, even if any slight changes in the speed of rotation of the transfer-and-transport belt 31 occur because of slight extension and contraction thereof caused by the contact with the cleaning member 37, such slight and random extension and contraction of the transfer-and-transport belt 31 caused by slight changes in the speed of rotation of the transfer-and-transport belt 31 are absorbed at least by the downstream part 31B, which is in a loose state, extending from the position where the transfer-and-transport belt 31 goes out of contact with the driving roller 32 up to the transfer part. Therefore, such changes in the speed of rotation of the transfer-and-transport belt 31 are substantially eliminated.

Consequently, the transfer-and-transport belt 31 advances into and passes through the transfer part after any slight extension and contraction and changes in the speed of rotation are reduced or eliminated in the portion extending from the driving roller 32 up to the transfer part. Therefore, the transfer-and-transport belt 31 passes through the transfer nip NP stably at the same speed as the photoconductive drum 21 because the speed of rotation of the transfer-and-transport belt 31 is controlled by the speed of rotation of the photoconductive drum 21 as described above. Accordingly, the recording sheet 9 that is held on the outer peripheral surface of the transfer-and-transport belt 31 and is about to be introduced into the transfer part passes through the transfer part stably at substantially the same speed as the photoconductive drum 21. Hence, the occurrence of the speed difference between the recording sheet 9 and the image carrying surface of the photoconductive drum 21 is suppressed as much as possible.

Therefore, during the transfer of the toner image to the recording sheet 9 by the transfer-and-transport device 3, the recording sheet 9 moves following the rotation of the photoconductive drum 21. Thus, the occurrence of the speed difference between the recording sheet 9 and the photoconductive drum 21 (in other words, the occurrence of slipping) is suppressed. Consequently, the toner image is transferred to the recording sheet 9 in a good manner with no distortion of the image (with no nonuniformity in the image). That is, employing the transfer-and-transport device 3 suppresses the occurrence of transfer nonuniformity such as image nonuniformity.

Furthermore, in the image forming apparatus 1 including the transfer-and-transport device 3, since the transfer-and-transport device 3 transfers the toner image to the recording sheet 9 in a good manner without causing transfer nonuniformity, a high-quality image without distortion is formed on the recording sheet 9.

Evaluation Tests on Transfer-and-Transport Device

To demonstrate the performance of suppressing transfer nonuniformity in the transfer-and-transport device 3 (Working Example) according to the first exemplary embodiment, the following evaluation tests are conducted.

Preparation for Evaluation Tests

First, to find criteria for the evaluation of transfer nonuniformity, plural samples (image-formed objects) exhibiting different kinds of image nonuniformity are prepared, and a sensory test and a measurement for evaluation of image nonuniformity are conducted on each of the samples.

The plural samples are obtained as follows. Plural transfer-and-transport devices 30B are prepared as Comparative Example 2 to be described below, with various conditions of the transfer-and-transport belt 31, the cleaning member 37 of the belt cleaning device 36, and other associated elements. Then, test images are formed by image forming apparatuses 1 to which the transfer-and-transport devices 30B are attached, respectively. Thus, plural recording sheets 9 on which the test images are formed (plural image-formed objects) are obtained as samples.

Figure 10A:
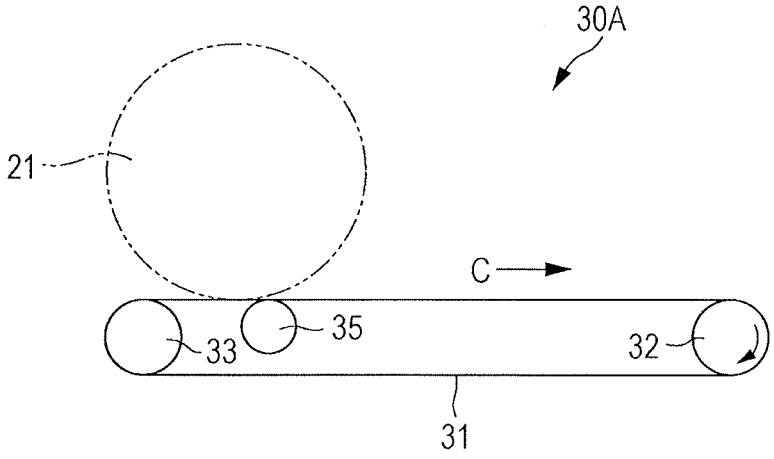
FIG. 10A schematically illustrates a transfer-and-transport device according to Comparative Example 1 used in the evaluation tests.
Figure 10B:
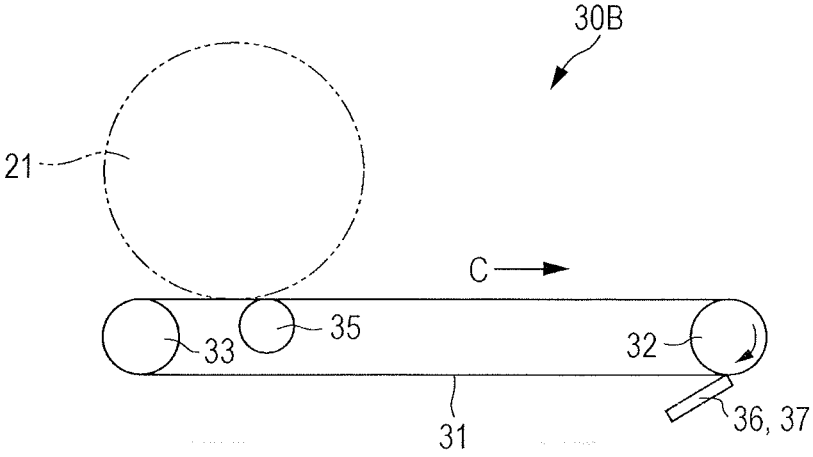
FIG. 10B schematically illustrates a transfer-and-transport device according to Comparative Example 2 used in the evaluation tests and in the preparation for the evaluation tests.

The transfer-and-transport devices 30B according to Comparative Example 2 are each obtained by changing the positions of the driving roller 32 and the releasing-side roller 33 with each other, as illustrated in FIG. 10B, in the transfer-and-transport device 3 according to the first exemplary embodiment.

The conditions of the elements included in the transfer-and-transport devices 30B are selected from those that may cause the extension and/or contraction of the toner image during the transfer of the toner image. For example, the transfer-and-transport belt 31 is conditioned to have distortion and surface deterioration. Distortion of the transfer-and-transport belt 31 is produced by attaching the transfer-and-transport belt 31 to an image forming apparatus 1 and using the transfer-and-transport belt 31, and by forcibly stretching the transfer-and-transport belt 31 so that the Young's modulus and the length of the transfer-and-transport belt 31 are changed (actually, the Young's modulus is lowered, and the length is increased). Surface deterioration of the transfer-and-transport belt 31 is caused by rubbing the outer peripheral surface of the transfer-and-transport belt 31 with the cleaning member 37 of the belt cleaning device 36 and thus giving slight roughness to the outer peripheral surface of the transfer-and-transport belt 31. The condition of the cleaning member 37 is varied by changing, for example, the attaching angle and the amount of biting.

Using the image forming apparatuses 1 including the transfer-and-transport devices 30B of different kinds defined by the above conditions, test images are formed on recording sheets 9, whereby plural samples are obtained.

Figure 4:
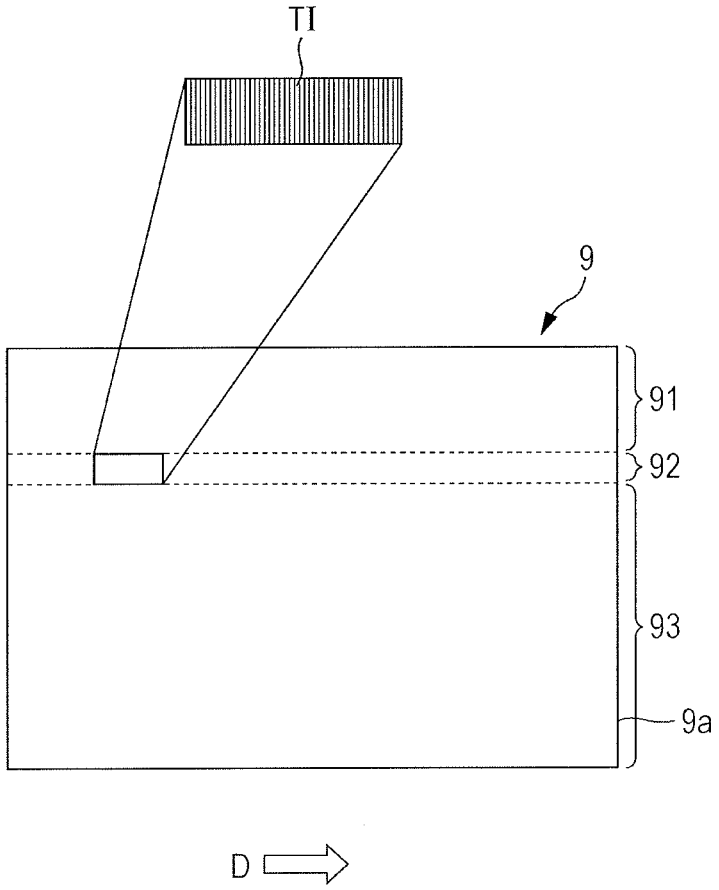
FIG. 4 is a plan view of test images formed in evaluation tests and preparation of the evaluation tests, including an enlargement of a part of one of the test images.

Referring to FIG. 4, the test images are formed on recording sheets 9 of the largest one (for example, the A3 size conforming to a Japanese Industrial Standard (JIS)) of sizes that are handleable by the image forming apparatus 1. While each of the recording sheets 9 is transported in a direction represented by an arrow D (hereinafter referred to as processing direction D) with a short side 9*a* thereof being the leading end, halftone images for the sensory test are formed in areas 91 and 93, respectively, of the recording sheet 9, and a thin-line image TI for image nonuniformity measurement is formed in an area 92, which is an area of the recording sheet 9 excluding the areas 91 and 93.

The recording sheet 9 is plain paper (uncoated paper) having a basis weight of about 80 gsm. The halftone images are each an image whose image area ratio is about 50%. The thin-line image TI is a ladder-chart image composed of straight lines (each having a length of 20 mm and a constant width) each extending in a direction orthogonal to the processing direction D. The straight lines are drawn with a resolution of 600 dpi and at an interval corresponding to five straight lines.

The speed of rotation (peripheral velocity) of the driving roller 32 supporting the transfer-and-transport belt 31 in each of the transfer-and-transport devices 30B is set to the same value as the speed of rotation (peripheral velocity) of the photoconductive drum 21.

Subsequently, the plural recording sheets 9 having the above test images are visually observed and are evaluated on the basis of plural levels of density nonuniformity in the halftone images, ranging from a level that is negligible in practical use to a level that is of very poor quality. The density nonuniformity is exhibited in the form of bands (horizontal stripes) each extending in a direction substantially orthogonal to the processing direction D. In each of the below-described tests, eleven image-formed objects that exhibit different levels of image nonuniformity are selected as samples.

Subsequently, a sensory test on image nonuniformity is conducted on each of the eleven samples. In the sensory test, the halftone image formed in the area 93 of each of the recording sheets 9 as the samples is visually inspected by a third person, and in which of the samples the density nonuniformity in the form of horizontal stripes is not noticeable is determined. Furthermore, for each of samples in which the density nonuniformity in the form of horizontal stripes is noticeable, positions where the nonuniformity is noticeable are identified.

On the other hand, a measurement of image nonuniformity is also conducted on each of the eleven samples. In the measurement, the entirety of the thin-line image TI (the ladder-chart image) formed in the area 92 of each of the recording sheets 9 as the samples is scanned from the leading end to the trailing end thereof in the processing direction D, and the width of each line is measured. Subsequently, on the basis of the measured data, the difference (in the absolute value) of the width of each line in the thin-line image TI on the sample from the theoretical value (the width of each line defined in the image data) is calculated. Furthermore, the sum (integral) of the above differences for all of the lines in the thin-line image TI on the sample is calculated.

Figure 5A:
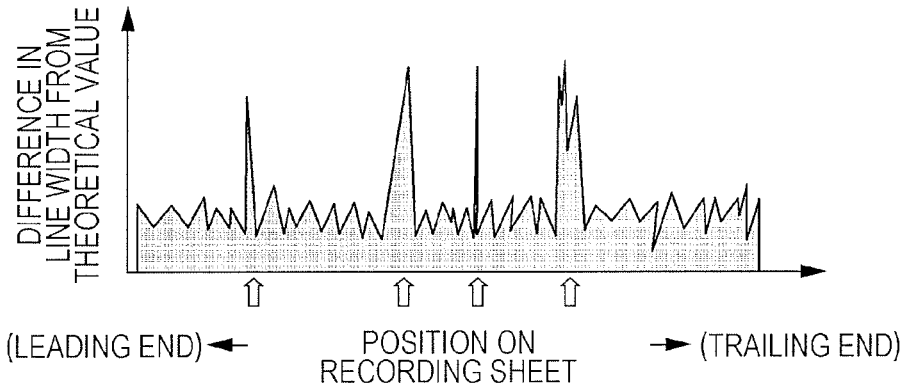
FIGS. 5A and 5B are graphs conceptually illustrating the results of measurements conducted on some of samples used in the preparation of the evaluation tests.
Figure 5B:
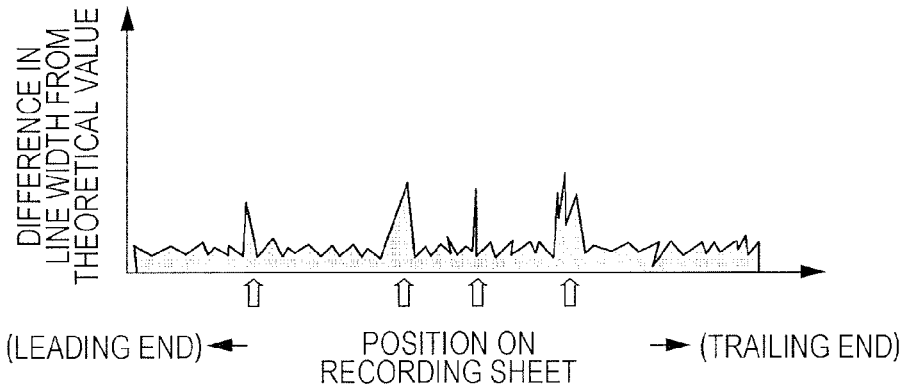

Some of the results of the measurement are graphed in FIGS. 5A and 5B. The result graphed in FIG. 5A is of a poor-quality sample in which the level of density nonuniformity in the form of horizontal stripes is close to the most noticeable level. The result graphed in FIG. 5B is of a high-quality sample in which the level of density nonuniformity in the form of horizontal stripes is close to the least noticeable level in practical use. The hatched part (area) of the graph in each of FIGS. 5A and 5B represents the sum of the differences. Upward-pointing white arrows illustrated in FIGS. 5A and 5B indicate peaks in the data obtained in the measurement of density nonuniformity.

Lastly, the results of the sensory test conducted on the eleven samples are compared with the results of the measurement of density nonuniformity, and it is checked whether or not the positions on the recording sheet 9 where the density nonuniformity in the form of horizontal stripes is noticeable in the sensory test coincide with the positions of the peaks (for example, positions indicated by the upward-pointing white arrows in FIGS. 5A and 5B) obtained in the measurement of density nonuniformity. As a result, the positions in the sensory test and the positions in the measurement coincide with each other.

Figures 6, 7:
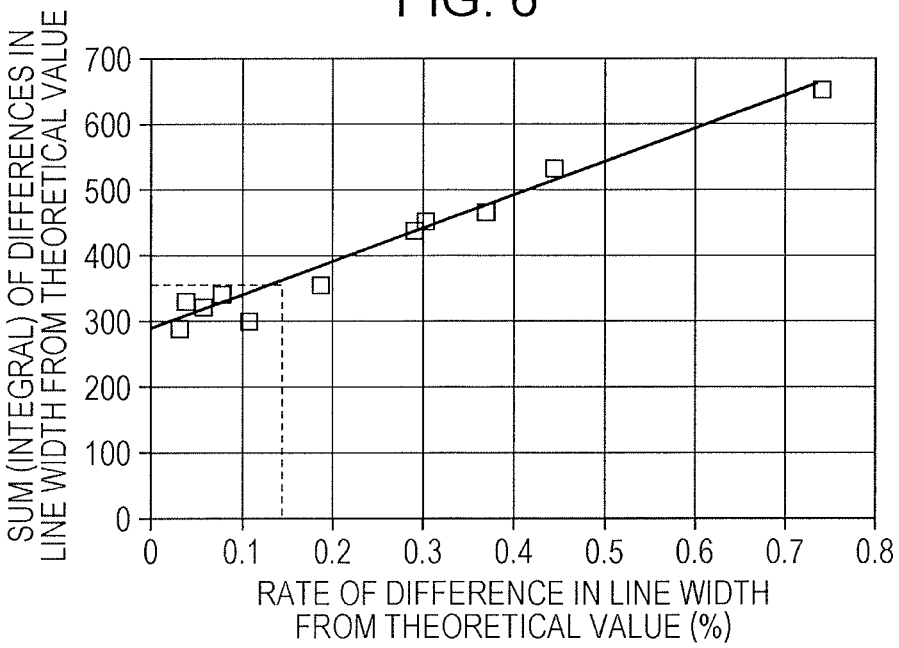
FIG. 6 is a graph illustrating the correlation between the rate of difference in line width from a theoretical value and the sum of differences in line width from the theoretical value obtained in the in the preparation of the evaluation tests.
FIG. 7 is a table summarizing the results of measurements of the rate of difference in line width from the theoretical value in Evaluation Test 1.

Furthermore, the differences of the measured density-nonuniformity peaks from the theoretical value are calculated in percentages for each of the eleven samples, and the average of the differences is calculated as "the rate of image distortion" for each of the samples. Then, the correlation between the rate of image distortion and the sum of the differences is examined. Strictly speaking, image distortion is assumed to occur because of instantaneous slipping of the recording sheet 9 with respect to the photoconductive drum 21. Therefore, the rate of image distortion is also regarded as "the slipping rate." FIG. 6 is a graph illustrating the above correlation observed among the eleven samples, with the horizontal axis representing the rate of difference in line width from the theoretical value and the vertical axis representing the sum of the differences in line width from the theoretical value. The line extending obliquely in the graph is the approximate line obtained on the basis of the results of the measurements. It is found that there is a linear correlation between the rate of difference in the line width and the sum of the differences, as is represented by the approximate line in FIG. 6.

In the above sensory test, the results for the samples in which the density nonuniformity in the form of horizontal stripes is not noticeable are concentratedly plotted on the left side of the graph illustrated in FIG. 6, more specifically, in a zone defined by the rate of difference in line width of 0.15% or lower and the sum of the differences of about 350 or below.

Hence, the allowable level, as the criteria for the evaluation, of transfer nonuniformity is regarded as 0.15% or lower for the rate of difference in line width and about 350 or smaller for the sum of differences in line width.

For reference, even if the rate of difference in line width is about 0.20%, the density nonuniformity in the form of horizontal stripes in the resulting image is negligible in practical use.

Evaluation Test 1

Using the transfer-and-transport device 3 (Working Example) according to the first exemplary embodiment, Evaluation Test 1 for inspecting the rate of image distortion is conducted. Furthermore, transfer-and-transport devices 30A and 30B according to Comparative Examples 1 and 2 that are configured as illustrated in FIGS. 10A and 10B, respectively, are prepared for comparison with Working Example, and Evaluation Test 1 is also conducted for Comparative Examples 1 and 2.

The transfer-and-transport device 30A according to Comparative Example 1 illustrated in FIG. 10A is obtained by changing (replacing) the positions of the driving roller 32 and the releasing-side roller 33 with each other and omitting the belt cleaning device 36 (the plate-like or substantially plate-like cleaning member 37) in the transfer-and-transport device 3 according to the first exemplary embodiment. The transfer-and-transport device 30B according to Comparative Example 2 illustrated in FIG. 10B is obtained as described above.

The speed of rotation (peripheral velocity) of the driving roller 32 in each of the transfer-and-transport devices 3, 30A, and 30B is set to the same as the speed of rotation (peripheral velocity) of the photoconductive drum 21.

The rate of image distortion is measured in the same manner as in the case of the rate of image distortion obtained on the basis of the measurement conducted in the above preparation for the evaluation tests.

Evaluation Test 1 is conducted for two cases: specifically, a case where a brand-new transfer-and-transport belt 31 (hereinafter referred to as brand-new belt) is attached to each of the transfer-and-transport devices 3, 30A, and 30B, and a case where a deteriorated transfer-and-transport belt 31 (hereinafter referred to as deteriorated belt) is attached to each of the transfer-and-transport devices 3, 30A, and 30B. The deteriorated belt is one of the transfer-and-transport belts 31 used in the preparation for the evaluation tests. For example, the deteriorated belt is obtained by distorting the belt and deteriorating the surface condition of the belt. More specifically, the deteriorated belt has a Young's modulus of below about 5 MPa, a free length of about 1.5% longer than the brand-new belt, and a rough outer peripheral surface with very small irregularities.

FIG. 7 is a table that summarizes the results of Evaluation Test 1.

As summarized in the table in FIG. 7, in the transfer-and-transport device 3 according to Working Example, the rate of difference in line width falls within the allowable range (0.20% or below) in both cases of the brand-new belt and the deteriorated belt and is lower than those of Comparative Examples 1 and 2.

In the transfer-and-transport devices 30B according to Comparative Example 2, the rate of difference in line width is greater than those of Working Example and Comparative Example 1 even if the transfer-and-transport belt 31 is brand new. Particularly, in the case where the transfer-and-transport belt 31 is deteriorated, the rate of difference in line width is more than twice that of the case of the brand-new belt.

Evaluation Test 2

Evaluation Test 2 is conducted as follows.

In Evaluation Test 2, the image forming apparatuses 1 each including the transfer-and-transport device 3 according to Working Example and used in Evaluation Test 1 are used, but the speed of rotation of the driving roller 32 is varied with respect to the speed of rotation of the photoconductive drum 21. Thus, nine image forming apparatuses 1 with respective speed differences of the driving roller 32 from that of the photoconductive drum 21 are prepared, and the rate of difference in line width is calculated for each of the image forming apparatuses 1.

The nine kinds of speed differences are each expressed as $[(Vd-Vp)/Vp]\times100(\%)$, where Vd denotes the speed of rotation of the driving roller 32, and Vp denotes the speed of rotation of the photoconductive drum 21. Specifically, the speed differences from the reference of 0% are set to −1% and 1 to 8% (integral values only). The negative speed difference means that the speed of rotation of the photoconductive drum 21 is higher than that of the driving roller 32. The positive speed difference means that the speed of rotation of the driving roller 32 is higher than that of the photoconductive drum 21.

The rate of image distortion is measured in the same manner as in the case of the rate of image distortion obtained on the basis of the measurement conducted in the above preparation for the evaluation tests. The transfer-and-transport belts 31 used in Evaluation Test 2 are the deteriorated belts used in Evaluation Test 1 (technically, belts deteriorated to an extent corresponding to those used over the standard lifetime).

Figure 8:
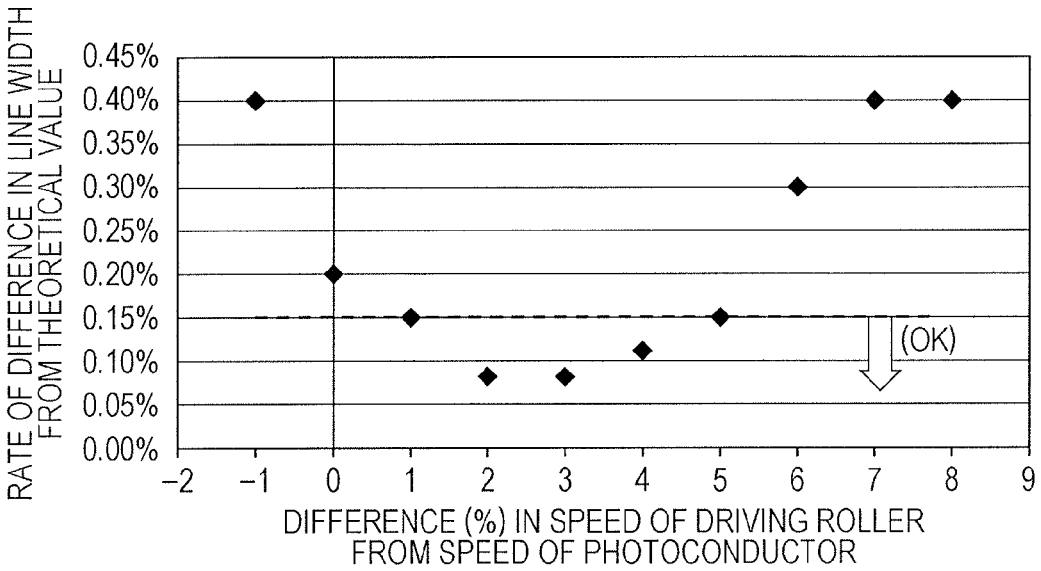
FIG. 8 is a graph illustrating the relationship between the speed difference between a photoconductive drum and a driving roller and the rate of difference in line width from the theoretical value obtained in Evaluation Test 2.

FIG. 8 is a graph illustrating the results of Evaluation Test 2.

As graphed in FIG. 8, when the speed difference is positive, the rate of difference in line width tends to be small but gradually increase when the speed difference exceeds a certain positive value.

The graph in FIG. 8 also shows that when the speed difference is within a positive range of 1 to 5% (integrals only), the rate of difference in line width falls within the allowable range of 0.15% or below. In Evaluation Test 2, when the speed difference is set to any of the values within the allowable range, image distortion in the resulting halftone image included in the test images is not clearly visible, that is, the image distortion is assuredly allowable in practical use.

Hence, in the transfer-and-transport device 3, if the speed of rotation Vd of the driving roller 32 is set to a value producing "a speed difference of 1% or greater and 5% or smaller or about 1% or greater and about 5% or smaller" from the speed of rotation Vp of the photoconductive drum 21, the occurrence of transfer nonuniformity due to image distortion or the like is assuredly suppressed.

OTHER EXEMPLARY EMBODIMENTS

In the transfer-and-transport device 3, the cleaning member 37 of the belt cleaning device 36 may be in contact with the transfer-and-transport belt 31 at any of positions in an area described below.

Figure 9:
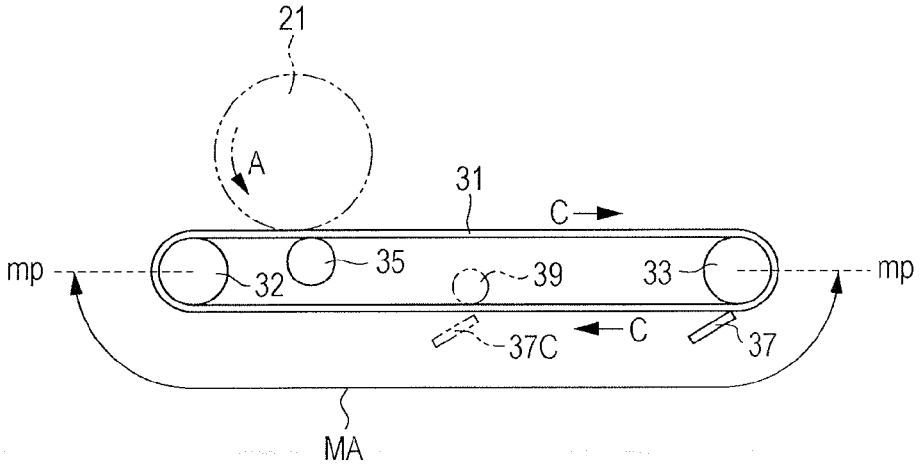
FIG. 9 schematically illustrates the position of a cleaning member included in a transfer-and-transport device according to another exemplary embodiment.

Specifically, referring to FIG. 9, the cleaning member 37 may be provided in contact with the transfer-and-transport belt 31 at a position in an area MA extending from, in the direction of rotation C, the midpoint mp of the portion that is wrapped around the driving roller 32 toward the upstream side up to the midpoint mp of the portion that is wrapped around the releasing-side roller 33.

The area MA includes the area ML extending from, in the direction of rotation C of the transfer-and-transport belt 31, the midpoint mp of the portion that is wrapped around the releasing-side roller 33 to the downstream end point ep of the portion. If the cleaning member 37(C) is provided in contact with a portion of the outer peripheral surface of the transfer-and-transport belt 31 that is not supported by any supporting rollers, a supporting member 39 in the form of a roller, a plate, or the like only needs to be provided at a position on the inner peripheral side of the transfer-and-transport belt 31 and across from the cleaning member 37(C) as illustrated by dash-dot-dot lines in FIG. 9.

The part of the transfer-and-transport belt 31 that is in the area MA corresponds to the upstream part 31A (see FIG. 3) of the transfer-and-transport belt 31 that is tensed by receiving the driving force from the driving roller 32. Therefore, even if any cleaning member 37 is provided in contact with a position in the area MA, the transfer-and-transport belt 31 stably rotates with substantially no changes in the speed of rotation thereof that may be caused by the contact with the cleaning member 37 because of the reason described above.

Furthermore, even if any slight changes in the speed of rotation of the transfer-and-transport belt 31 occur because of slight and random extension and contraction of the transfer-and-transport belt 31 caused by the contact with the cleaning member 37, such slight and random extension and contraction of the transfer-and-transport belt 31 are absorbed by the downstream part 31B of the transfer-and-transport belt 31 that is in a loose state because of the reason described above. Therefore, such changes in the speed of rotation of the transfer-and-transport belt 31 are substantially eliminated.

Hence, transfer nonuniformity such as image distortion is suppressed also in the transfer-and-transport device 3 including the cleaning member 37 provided in contact with the transfer-and-transport belt 31 in the area ML.

In the first exemplary embodiment, the transfer-and-transport belt 31 of the transfer-and-transport device 3 is supported by the two supporting rollers 32 and 33, exclusive of the transfer roller 35. Alternatively, the transfer-and-transport belt 31 may be supported by three or more supporting rollers. The term "supporting roller" used herein refers to a roller around the outer peripheral surface of which the transfer-and-transport belt 31 is wrapped by a relatively large length, and does not refer to a roller that supports the transfer-and-transport belt 31 by being in contact with and bending only a small part of the inner peripheral surface of the transfer-and-transport belt 31.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer-and-transport device comprising:

a substantially annular belt that rotates in such a manner as to transport a recording medium received by an outer peripheral surface of the belt, the belt releasing the recording medium from the outer peripheral surface after transporting the recording medium, the belt being stretchable in a direction of rotation of the belt;

a transfer roller that is rotatably provided such that the outer peripheral surface of the belt is pressed against a photoconductor, the photoconductor being driven to rotate while carrying a toner image to be transferred to the recording medium;

a plurality of supporting rollers that support the belt at respective positions avoiding the transfer roller and such that the belt is rotatable in a tensed state; and a substantially plate-like cleaning member that cleans the outer peripheral surface of the belt with one end of the cleaning member being in contact with the outer peripheral surface of the belt, wherein one of the plurality of supporting rollers serves as a driving roller provided at a position, in the direction of rotation of the belt, on an upstream side with respect to the transfer roller and on a side where the recording medium starts to be received by the belt, wherein another one of the plurality of supporting rollers serves as a releasing-side roller provided at a position, in the direction of rotation of the belt, on a downstream side with respect to the transfer roller and on a side where the recording medium is released from the belt, and wherein the cleaning member is in contact with the belt at a position in an area extending from, in the direction of rotation of the belt, a midpoint of a portion of the belt that is wrapped around the driving roller toward the upstream side up to a midpoint of a portion of the belt that is wrapped around the releasing-side roller, wherein the cleaning member is in contact with the belt at a position in an area extending from, in the direction of rotation of the belt, the midpoint of the portion of the belt that is wrapped around the releasing-side roller to a downstream end point of the portion.

2. The transfer-and-transport device according to claim 1, wherein a speed of rotation of the driving roller is higher than a speed of rotation of the photoconductor.

3. The transfer-and-transport device according to claim 2, wherein the speed of rotation of the driving roller is set to a value that produces a speed difference of about 1% or greater and about 5% or smaller from the speed of rotation of the photoconductor.

4. An image forming apparatus comprising:

the transfer-and-transport device according to claim 1.

* * * * *